US006834434B2

(12) United States Patent
Nelson

(10) Patent No.: US 6,834,434 B2
(45) Date of Patent: Dec. 28, 2004

(54) SPRING-LOADED ENGRAVING TOOLHOLDER

(76) Inventor: Lance Nelson, 5 Rock Ave., Hudson, MA (US) 01749

( * ) Notice: Subject to any disclaimer, the term of this patent is extended or adjusted under 35 U.S.C. 154(b) by 0 days.

(21) Appl. No.: 10/668,647

(22) Filed: Sep. 23, 2003

(65) Prior Publication Data

US 2004/0060180 A1 Apr. 1, 2004

Related U.S. Application Data

(60) Provisional application No. 60/414,804, filed on Sep. 30, 2002.

(51) Int. Cl.[7] ..... B43L 13/00
(52) U.S. Cl. ..... 33/18.1
(58) Field of Search ..... 33/18.1, 18.2, 33/21.1, 551, 553

(56) References Cited

U.S. PATENT DOCUMENTS

| | | | | |
|---|---|---|---|---|
| 1,705,957 A | | 3/1929 | Braren | |
| 2,009,671 A | * | 7/1935 | Mueller et al. | 33/21.1 |
| 2,744,329 A | | 5/1956 | Way et al. | 33/18.1 |
| 2,810,960 A | | 10/1957 | Johnson et al. | 33/18.1 |
| 2,902,760 A | | 9/1959 | Koenig | |
| 3,384,965 A | | 5/1968 | Sicking | 33/18.1 |
| 3,753,384 A | | 8/1973 | Anfindsen | 33/18.1 |
| 3,864,695 A | * | 2/1975 | Nagashima et al. | 33/18.1 |
| 4,466,193 A | * | 8/1984 | Astle | 33/21.1 |
| 4,991,274 A | | 2/1991 | Fortier et al. | |
| 5,212,874 A | * | 5/1993 | Anderson et al. | 33/18.1 |
| 6,021,574 A | * | 2/2000 | Murray, III | 33/18.1 |
| 6,138,365 A | | 10/2000 | Wilkins | 33/25.2 |
| 6,212,784 B1 | * | 4/2001 | Pittman | 33/18.1 |
| 6,319,747 B1 | * | 11/2001 | Todisco et al. | 33/18.1 |
| 6,422,793 B1 | * | 7/2002 | Todisco et al. | 33/18.1 |
| 6,460,258 B1 | * | 10/2002 | Shimotoyodome | 33/18.1 |

OTHER PUBLICATIONS

Antares, Inc., Engraving Fact Sheets, "Burnishing" (1998–2001).

Antares, Inc., Engraving Fact Sheets, "EZ–Rider Burnishing Attachment" (1998–2001).

* cited by examiner

*Primary Examiner*—Christopher W. Fulton
(74) *Attorney, Agent, or Firm*—Weingarten, Schurgin, Gagnebin & Lebovici LLP

(57) ABSTRACT

A spring-loaded engraving toolholder applies a relatively constant pressure to an engraving toolbit as the toolbit is pushed against a material to be marked. The spring-loaded engraving toolholder is held in a collet or endmill toolholder and placed into the spindle of a standard numerical control (N.C.) milling type machine. When the toolbit is pressed against a material and moved along the surface, a consistent mark is produced even if the surface of the material is uneven or not parallel to the plane of motion of the machine.

54 Claims, 7 Drawing Sheets

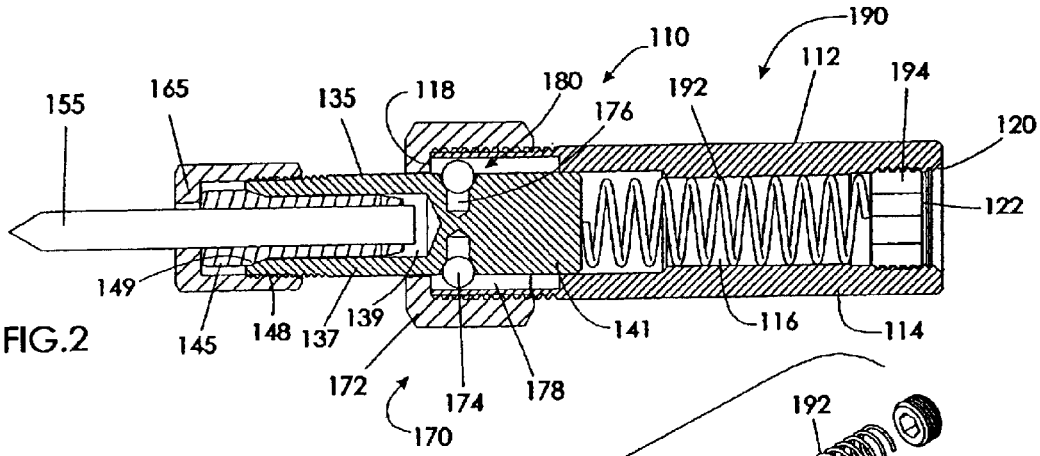
FIG.2
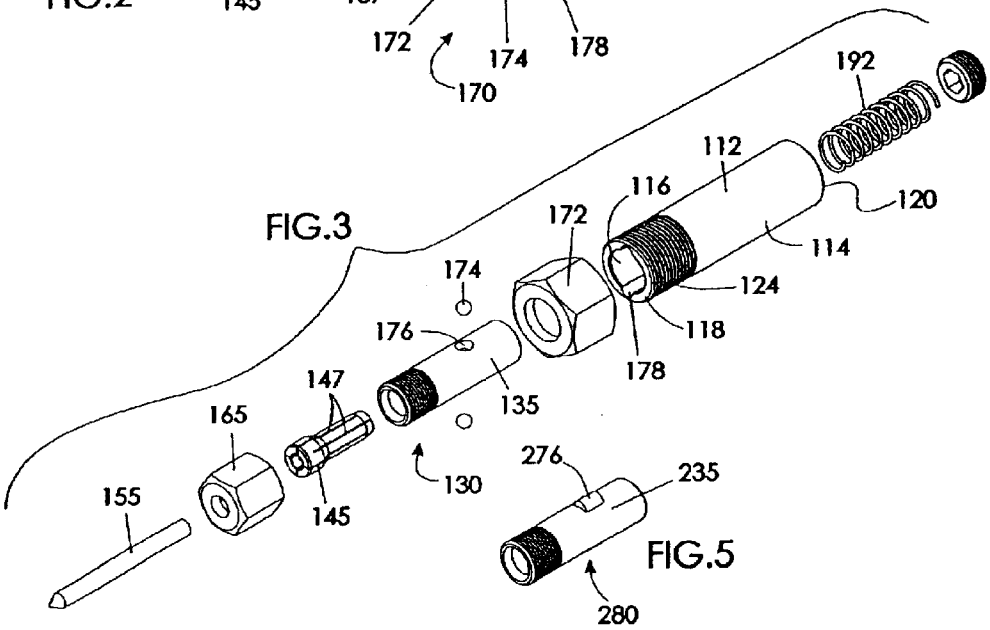
FIG.3
FIG.5
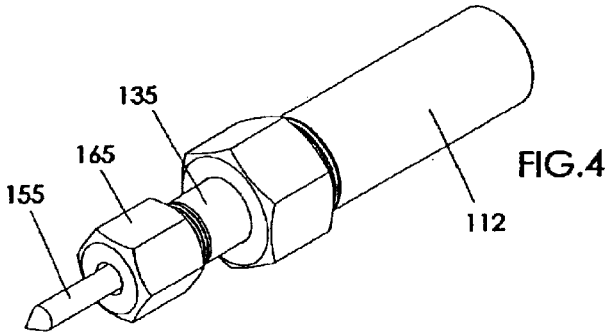
FIG.4

FIG.15
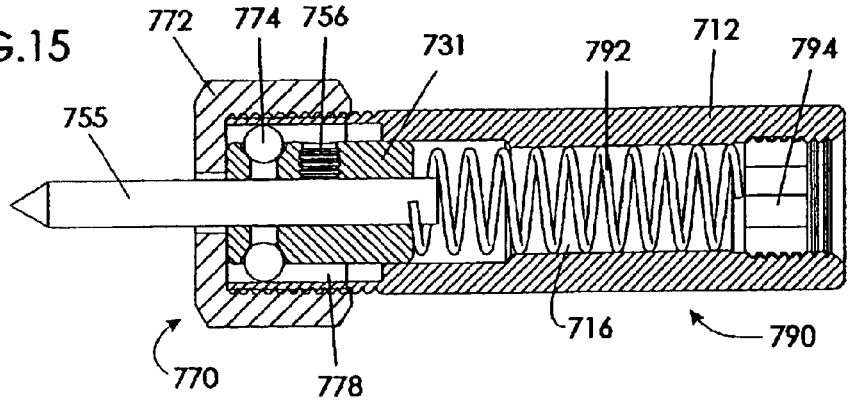
FIG.16
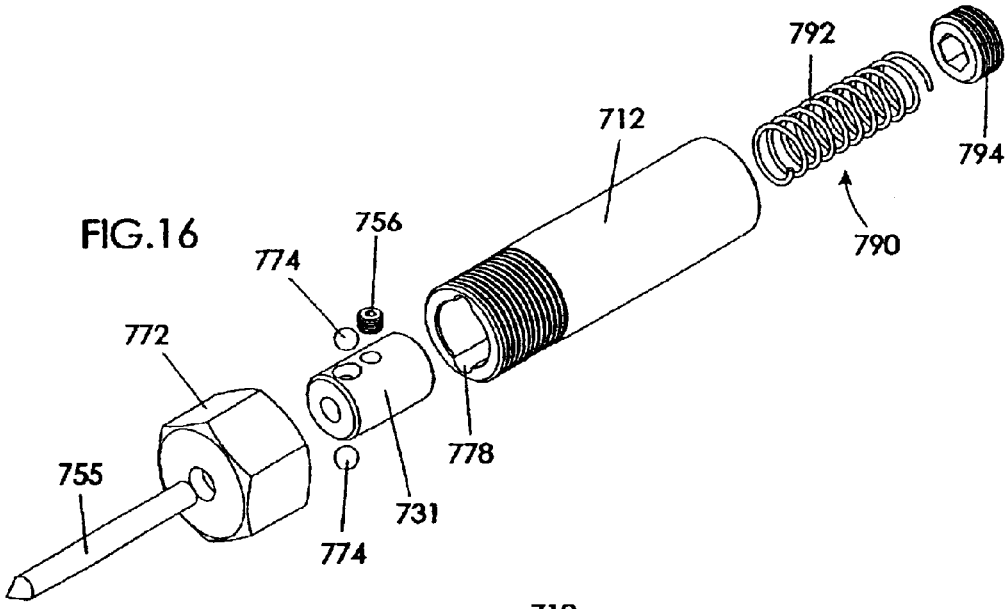
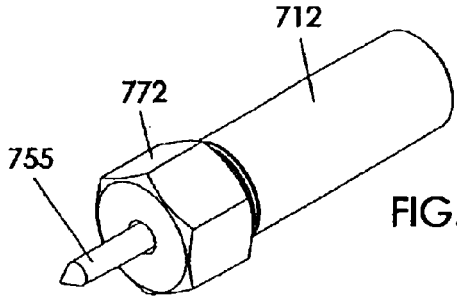
FIG.17

SPRING-LOADED ENGRAVING TOOLHOLDER

CROSS REFERENCE TO RELATED APPLICATIONS

This application claims priority under 35 U.S.C. §119(e) to U.S. Provisional Patent Application No. 60/414,804, filed on Sep. 30, 2002, the disclosure of which is incorporated by reference herein.

STATEMENT REGARDING FEDERALLY SPONSORED RESEARCH OR DEVELOPMENT

N/A

BACKGROUND OF THE INVENTION

This invention relates to engraving tools and toolholders.

The typical method of engraving or marking surfaces with a toolbit is to hold the toolbit with a rigid toolholder on a numerical control (N.C.) or manual engraving machine and plunge the toolbit down into the surface of the material a set distance. The tool is then moved along the surface of the material and marks are engraved into its surface. The toolbits generally have an angled point on them to produce a very fine mark. As the toolbit is driven deeper into the surface of the material being marked, the mark becomes wider due to the angle on the end of the toolbit. If the material being marked is not perfectly flat or level on the machine table, an uneven mark is produced. The depth of the mark is typically only a few thousandths of an inch, so slight variations in the surface of the material being marked will be seen by uneven engraving. Therefore careful attention must be paid when placing the material to be marked onto the table of the N.C. machine so the surface of the material is exactly level on the machine. If the material being marked has distinct surface irregularities such as a curved surface, the tool must be forced to exactly follow the irregular surface to produce a consistent mark.

Fortier and Roebuck (U.S. Pat. No. 4,991,274) developed a flexible toolholder for a burnishing cutter that uses a spring to provide pressure against the rotated toolbit. The intent of their invention is to thread the tool into the spindle of an engraving machine by means of a thread on the front of the toolholder. The engraving toolbit is held in place with a setscrew in a tool holding element. This setscrew is also the mechanism to prevent rotation of the toolbit within the toolholder. This invention is designed to be used in a specific type of engraving machine with a threaded spindle that could accept such a device. It can not be held in a collet or endmill type toolholder and can not be used on a N.C. milling machine. The toolbit sliding within the main body is the mechanism for retaining the vertical orientation of the toolbit. A precise fit between the toolbit and the main body is needed to prevent the toolbit from wobbling from side to side. If there is an imprecise fit between the toolbit and the main body, the point of the engraving toolbit will wobble from side to side and produce poor engraving. This design requires that a different size main body and tool holding element be produced for each different diameter toolbit that is needed. The spring that is used to provide the force against the toolbit is placed over the outside of the main body and retained by a threaded adjusting member.

Antares, Inc. (Horsham, Pa.) developed a device referred to as the EZ Rider Burnishing Attachment. It is similar to the 30 Fortier and Roebuck design in several ways. The method in which it is attached to the spindle of the engraving machine is via a thread on the front of the toolholder. It is not designed to be held in a collet or endmill type toolholder and can not be used on a N.C. milling machine. The toolbit sliding within the main body is the mechanism for retaining the vertical orientation of the toolbit. A precise fit between the toolbit and the main body is needed to prevent the tool from wobbling from side to side. This requires that a different size main body and tool holding element be produced for each different diameter toolbit that is needed. The toolbit is held in place with a setscrew in a tool holding element. This setscrew is also the mechanism to prevent rotation of the toolbit within the toolholder. The spring is held within the main body via an internal retaining ring.

Sicking (U.S. Pat. No. 3,384,965) developed a tool for holding engraving toolbits that uses an electric solenoid to push down on an engraving point. The engraving point is pushed down towards the surface being marked and is stopped at a preset depth by the invention. The toolholder incorporates a single ball bearing screwed in from the side, which resides in a slot cut into the inner shaft to prevent rotation of the engraving point within the toolholder. The toolholder is used exclusively for scribing the surface to be marked and is not intended to be rotated in a spindle of a N.C. machine while being held with a standard collet or endmill toolholder.

Anfindsen (U.S. Pat. No. 3,753,384) developed an apparatus to adjust the downward pressure of the tool by utilizing an electromagnet. A magnet is used to press down on the toolbit to provide uniform pressure against the toolbit when it is pressed against the material being marked. This device is not intended to be rotated in a spindle of a N.C. machine while being held with a standard collet or endmill toolholder.

Many inventions teach a method for producing pressure against a tool as can be seen by Koenig (U.S. Pat. No. 2,902,760), Johnson et al. (U.S. Pat. No. 2,810,960), Way et al. (U.S. Pat. No. 2,744,329), Braren (U.S. Pat. No. 1,705,957) and Wilkins (U.S. Pat. No. 6,138,365). None of these devices are intended to be held in a spindle of a N.C. machine using a standard collet or endmill toolholder and rotated while still providing constant pressure to an engraving tool. All of these devices require major modifications to be able to use different diameter toolbits.

SUMMARY OF THE INVENTION

The present invention relates to a spring-loaded toolholder that applies a relatively constant pressure to an engraving toolbit as it is pushed against the material being marked. The spring-loaded engraving toolholder is held in a collet or endmill toolholder and placed into the spindle of a standard numerical control (N.C.) milling type machine. The toolholder may either be rotated or not by the machine. When the toolbit is pressed against the material being marked and moved along the surface, a constant mark is produced even if the surface of the material is uneven or not parallel to the plane of motion of the machine.

The spring-loaded engraving toolholder of the invention may be easily held with a standard collet or endmill toolholder. When placed into the spindle of a N.C. milling machine or router, it will produce better quality engravings than a rigid (non-spring loaded) tool on uneven surfaces. The spring-loaded engraving toolholder incorporates a collet to hold the toolbit. This allows the toolbit to be easily changed once the spring-loaded engraving toolholder is mounted in a spindle of a N.C. milling machine. A turn of the collet nut is all that is required to release the toolbit from the collet. This also allows different diameter toolbits to be used by simply changing the collet to one having the required diameter.

DESCRIPTION OF THE DRAWINGS

The invention will be more fully understood from the following detailed description taken in conjunction with the accompanying drawings in which:

FIG. 2 is a cross sectional view of a first embodiment of a spring-loaded engraving toolholder of the present invention;

FIG. 3 is an exploded perspective view of the spring-loaded engraving toolholder of FIG. 2;

FIG. 4 is a perspective view of an assembled spring-loaded engraving toolholder of FIG. 2;

FIG. 5 is a perspective view of another embodiment of a collet holder incorporating a further anti-rotation mechanism;

FIG. 15 is a cross sectional view of another embodiment of a spring-loaded engraving toolholder of the present invention;

FIG. 16 is an exploded perspective view of the toolholder of FIG. 15;

FIG. 17 is a perspective view of the assembled toolholder of FIG. 15;

DETAILED DESCRIPTION OF THE INVENTION

Figure 1:
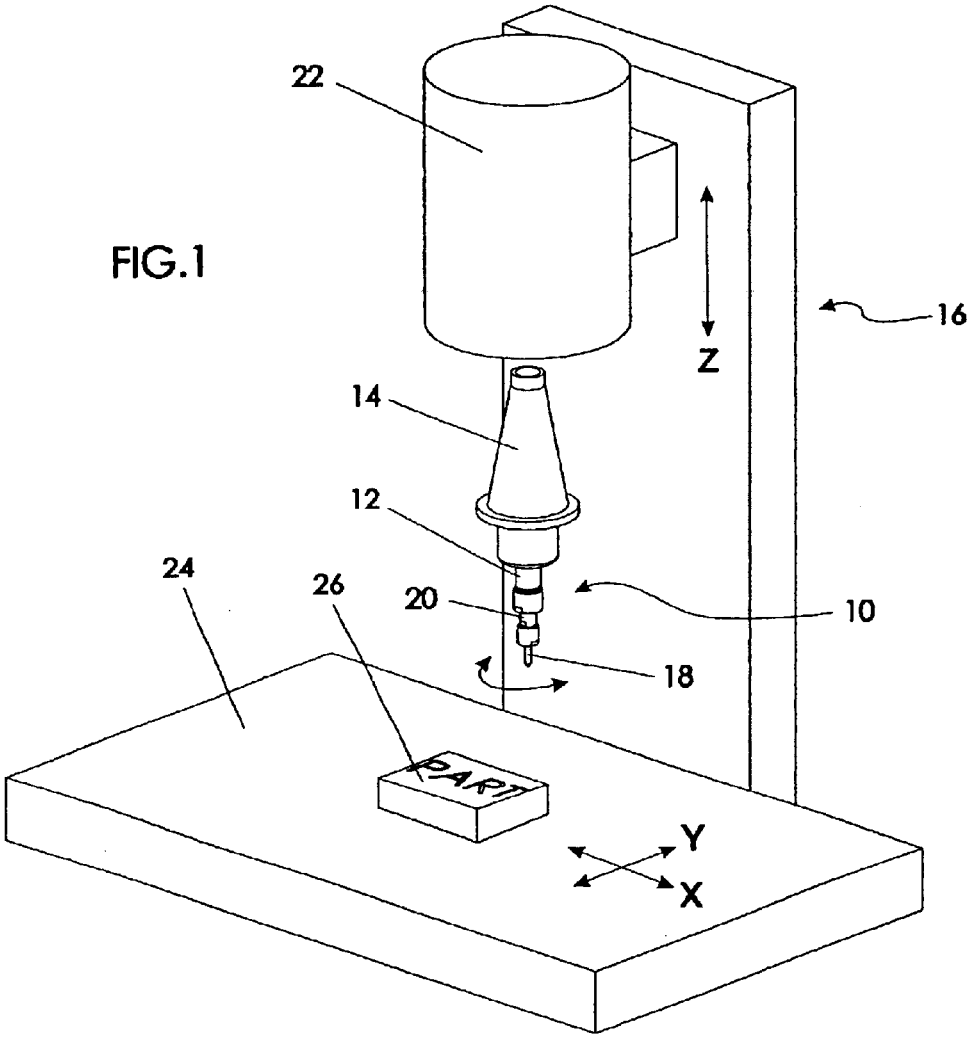
FIG. 1 is a perspective view of a spring-loaded engraving toolholder held in a collet or endmill toolholder and inserted into the spindle of an N.C. engraving machine.

Referring to FIG. 1, the present invention relates to a spring-loaded engraving toolholder 10 having a main body 12 configured to be held in a collet or endmill toolholder 14 of an engraving machine 16, which can be a numerical control (N.C.) machine or a manual machine. An engraving toolbit 18 is retained by a toolbit holder assembly 20 (described more fully below) in the main body 12. The toolbit holder assembly is disposed within the main body for reciprocal longitudinal translation along a longitudinal axis of the main body (parallel to the Z axis of the engraving machine) and is fixed against rotation within the main body. The toolbit holder assembly is biased by a biasing mechanism (described more fully below) in the main body in the direction of a workpiece to be engraved.

The assembled engraving toolholder 10, which is typically made of metal, such as steel, is placed into the spindle 22 of the engraving machine. The table 24 of the N.C. machine is able to move in the X and Y directions, indicated by the axes in FIG. 1. The spindle 22 of the N.C. machine is able to rotate the engraving toolholder if desired. The N.C. machine engraves or marks the surface of the workpiece 26 by plunging the toolbit 18 into the surface of the workpiece by moving the spindle 22 downwardly along the Z axis and moving the table 24 with the workpiece 26 mounted thereon in the desired X and Y directions to create engraving marks. The toolbit is able to slide freely up and down within the main body of the engraving toolholder. The biasing mechanism provides the required downward force to press the toolbit against the workpiece to create a mark. If the workpiece being marked is not perfectly level on the working table of the N.C machine or has an uneven, curved, or sloped surface, the biasing mechanism compensates for the misalignment and provides for an even engraving mark.

FIGS. 2–4 illustrate an exemplary first embodiment of a spring-loaded engraving toolholder 110 of the present invention. The main body 112 is configured as a hollow shaft 114 with a cylindrical outer shape configured to be held in a collet or endmill toolholder of an engraving machine. The shaft has a precisely bored hole 116 extending axially from an open front or toolbit end 118 to a back end 120, which is open in the illustrated embodiment. Internal threads 122 are formed on a portion of the bore 116 at the back end 120 of the main body 112. External threads 124 are formed on an outer portion of the shaft 114 of the main body 112 at the front end 118.

The toolbit holder assembly 130 includes a collet holder 135 sized to allow a sliding fit inside the bored hole 116 of the shaft 114. The collet holder 135 has a fore portion 137 with a bore 139 formed therein to receive a collet 145. A rear portion 141 of the collet holder 135 is retained within the front portion of the main body 112. The collet holder 135 is placed into the bored hole 116 of the shaft 114 to protrude through the open front end 118. A toolbit 155 is placed into the collet 145 that is then secured to the collet holder 135 in any suitable manner, such as with a collet nut 165. The collet 145 is suitably configured to clamp and grip the toolbit 155 when inserted in the collet holder 135. In the embodiment illustrated, the collet 145 is generally cylindrical with alternating splits 147 and a wedge surface 149 that cooperates with an opposing wedge surface 148 on the collet holder 135 to clamp down on the toolbit when held in place by the collet nut 165. Any other suitable gripping mechanism can be provided. Also, the toolbit can be readily changed by unscrewing the collet nut 165 and inserting a new toolbit.

A retaining mechanism 170 retains the collet holder 135 in the shaft while permitting limited longitudinal translation along the axis of the outer shaft. A rotational restraining mechanism 180 prevents rotation of the collet holder within the outer shaft, as described further below. In the embodiment illustrated, the retaining mechanism includes an end-cap 172 threaded onto the front end 118 of the main body 112. A retaining element or elements, such as ball bearings 174 placed in holes 176 in the rear portion 141 of the collet holder 135, travel in one or more longitudinal guides, such as slots 178, in the inner surface of the bore 116 of the main body 112. The ball bearings 174 retain the collet holder in the bore of the main body by contacting the endcap 172.

The rotational restraining mechanism 180 includes the longitudinal slots 178 in the inner surface of the bore 116 of the main body 112. The ball bearings 174 in the holes 176 in the collet holder 135 slide along the longitudinal slots 178 of the main body. While the ball bearings travel longitudinally along the slots, the slots prevent the ball bearings from traveling circumferentially within the bore, which prevents the collet holder from rotating. The slots may extend the entire length of the main body or only part of the length. The rotational restraining mechanism allows use of a rotating toolbit instead of a scribing point that is not rotated and just dragged along the surface of the material being marked.

The biasing mechanism 190 includes a compressible element, such as a spring 192 that fits closely within the bore 116 of the main body 112. A retaining member, such as a screw cap 194 screwed into the internally threaded back end of the main body, retains the spring in the bore. The spring can be retained in the main body in any other suitable manner, such as with an annular shoulder formed on the shaft or with a closed end wall. The forward end of the spring 192 applies pressure to the collet holder 135 and presses it toward the end cap 172 of the retaining mechanism 170.

In operation, when the toolbit 155 is pushed against a workpiece to be marked, the collet holder 135 slides toward the back end of the bored hole in the main body. The spring 192 provides pressure to push the toolbit back towards the workpiece. This allows for relatively constant pressure applied to the toolbit when it is in contact with the workpiece during engraving. Due to the precise fit between the collet holder and the bored hole of the outer shaft, a hole may be placed through the retaining screw to allow air to escape from behind the collet holder when movement occurs.

In a second embodiment, illustrated in FIG. 5, a rotational restraining mechanism 280 includes one or more protrusions 276 integrally formed with or permanently fixed onto the outside of a collet holder 235. The protrusions are slidable along longitudinal guides, such as the slots 178 of the main body illustrated in FIGS. 2 and 3. As above, the slots 178 may extend the entire length of the bore of the main body or only part of the length of the bore.

Figure 6:
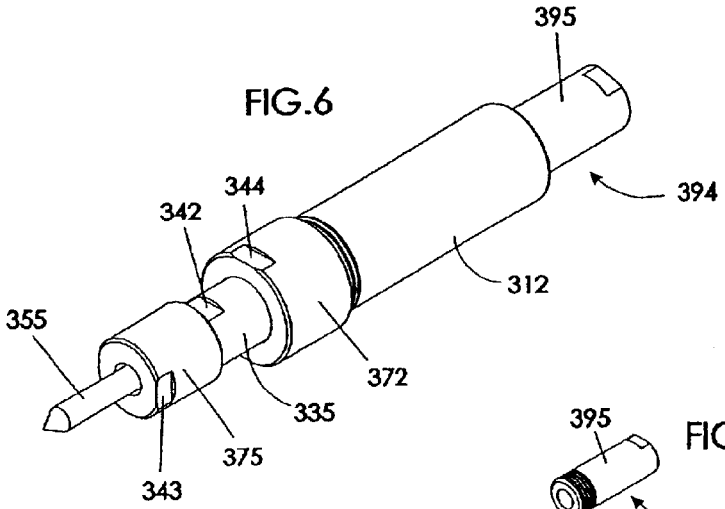
FIG. 6 is a perspective view of a further embodiment of a spring-loaded engraving toolholder including a shaft diameter reducer.

The collet nut 165 and endcap 172 may be hexagonally shaped as in FIG. 3 to allow them to be tightened with standard wrenches. Alternatively, a collet nut 375 and end cap 372 may be cylindrically shaped and include wrench flats 343 and 344 formed in their outer surfaces to facilitate tightening, as illustrated in FIG. 6. Other configurations such as spanner wrench holes could also be used.

Optionally, a wrench flat 342 may be formed on the collet holder 335, as shown in FIG. 6. This flat allows the collet holder to be held with a wrench while the collet nut 375 is tightened with another wrench. This allows for easier tightening of the collet nut 375 if the spring-loaded engraving toolholder is not being held in the spindle of a N.C. machine while the collet nut 375 is being tightened.

Figure 7:
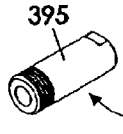
FIG. 7 is a perspective view of the shaft diameter reducer of the embodiment of FIG. 6.

An alternative design of a retaining member 394 can be seen in FIGS. 6 and 7 as a shaft diameter reducer 395. The shaft diameter reducer serves two functions. First, it provides the same function as the retaining screw cap 194 by applying pressure to the collet holder 335 and therefore the toolbit 355 by pressing against the biasing spring. The shaft diameter reducer 395 also extends from the back of the spring-loaded engraving toolholder and has an outer diameter that is smaller than the outer shaft diameter of the main body 312. This allows the spring-loaded engraving toolholder to be held in a smaller diameter collet or endmill toolholder. The shaft diameter reducer is shown assembled into the back of a spring-loaded engraving toolholder in FIG. 6.

Figure 8:
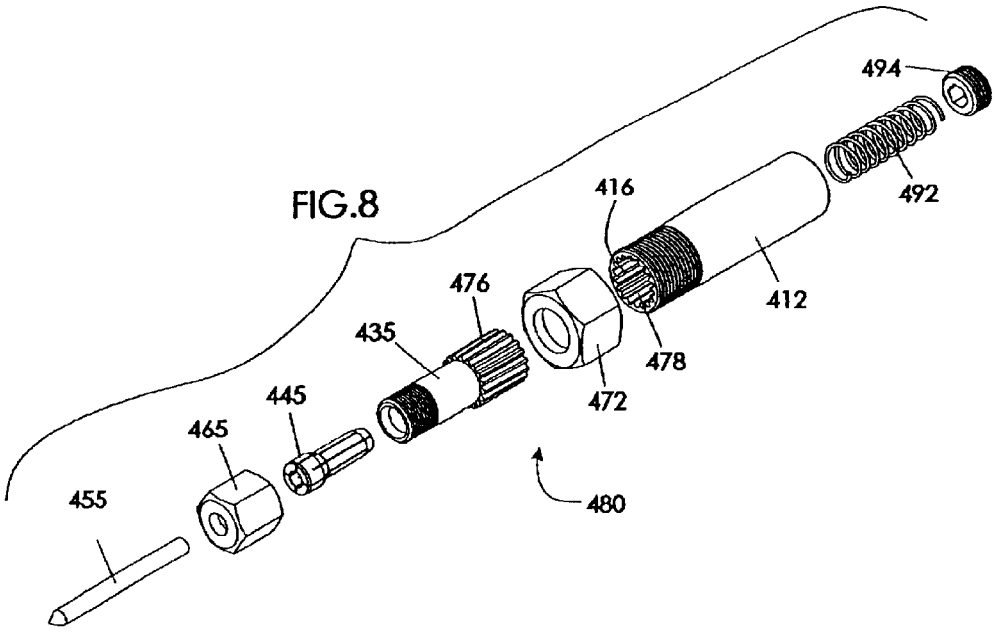
FIG. 8 is an exploded perspective view of a further embodiment of a spring-loaded engraving toolholder incorporating another anti-rotation mechanism.

A still further embodiment of the rotational restraining mechanism 480 is illustrated in FIG. 8. A spline, square, or other shaped configuration 476 incorporating one or more longitudinal grooves formed in a collet holder 435 can travel within a complementary configuration 478 formed in the bore 416 of the main body 412. Other illustrated elements, such as collet 445, toolbit 455, collet nut 465, end cap 472, spring 492, and screw cap 494, may be as previously described.

Figure 9:
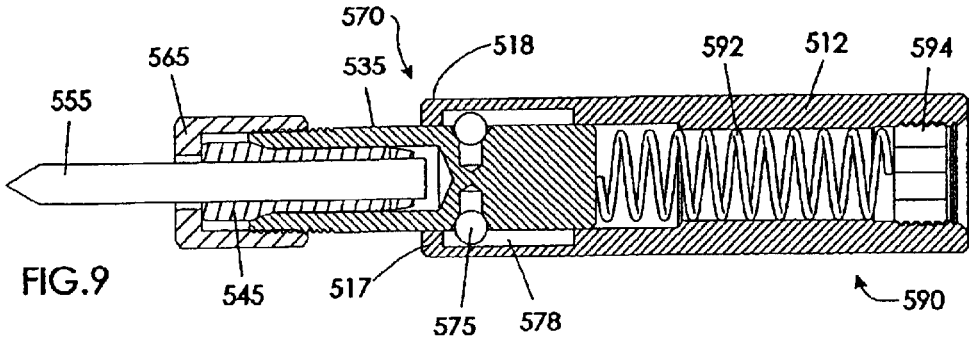
FIG. 9 is a cross sectional view of a further embodiment of a spring-loaded engraving toolholder of the present invention.
Figure 10:
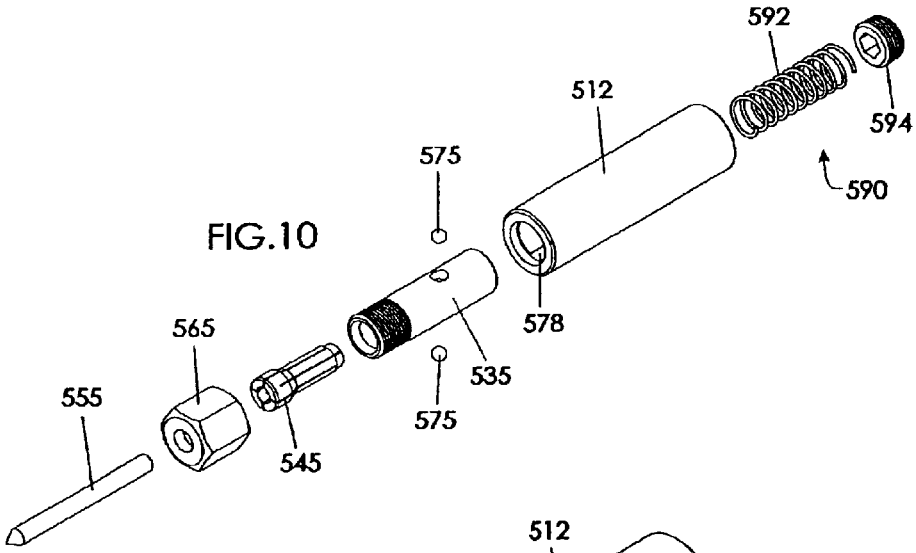
FIG. 10 is an exploded perspective view of toolholder of FIG. 9.
Figure 11:
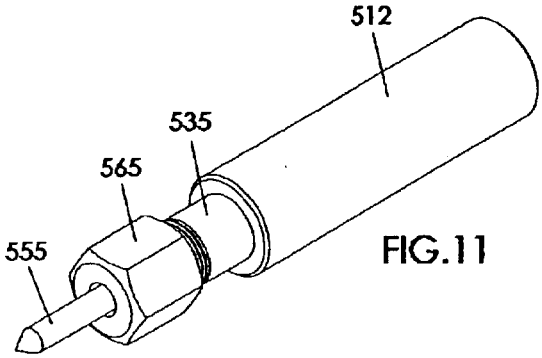
FIG. 11 is a perspective view of the assembled toolholder of FIG. 9.

A further embodiment of a retaining mechanism 570 to contain the collet holder within the main body is illustrated in FIGS. 9–11. In this embodiment, there is no need for the endcap 172 illustrated in FIGS. 2–4. Rather, an annular shoulder 517 is provided at the front end 518 of the main body 512, and one or more longitudinal guides, such as slots 578, are provided that do not extend through the shoulder. The shoulder allows one or more retaining elements, such as ball bearings 575 or integral protrusions (as shown in FIG. 5), to stop the collet holder 535 from being pushed out of the main body by a biasing mechanism 590, such as a spring 592. The longitudinal slots 578 may or may not extend to the back of the main body 512 for ease of assembly. Other illustrated elements, such as collet 545, toolbit 555, collet nut 565, and cap 594, may be as previously described.

Figure 12:
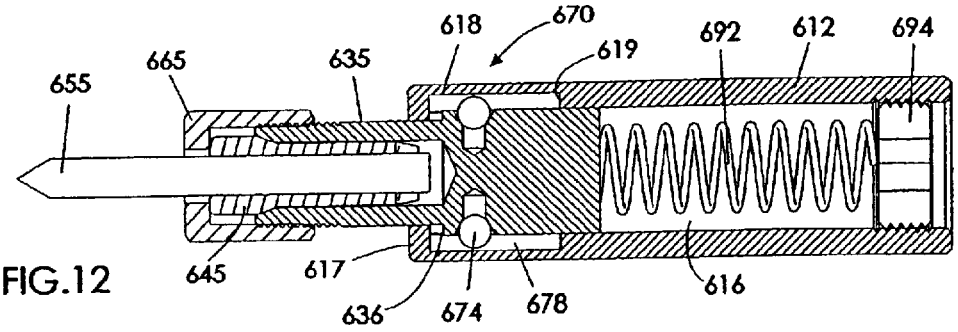
FIG. 12 is a cross sectional view of a still further embodiment of a spring-loaded engraving toolholder of the present invention.
Figure 13:
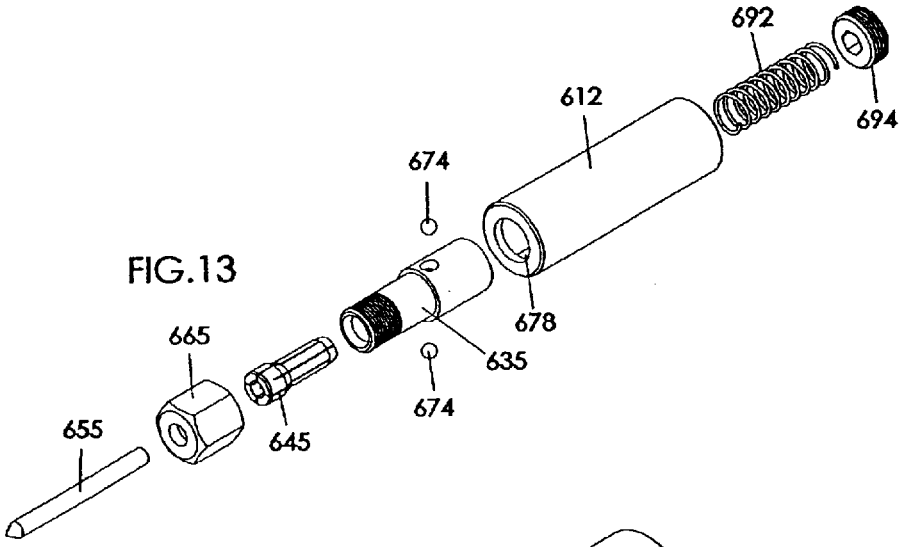
FIG. 13 is an exploded perspective view of the toolholder of FIG. 12.
Figure 14:
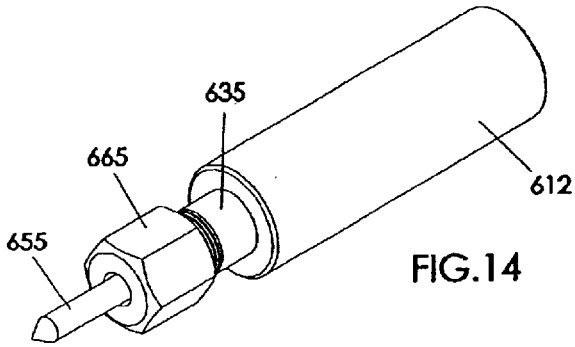
FIG. 14 is a perspective view of the assembled toolholder of FIG. 12.

FIGS. 12–14 illustrate another embodiment of a retaining mechanism 670 to contain a collet holder 635 within the main body 612. A step 636 placed in the collet holder 635 abuts the annular shoulder 617 at the front end 618 of the main body 612 to prevent the collet holder 635 from being pushed out of the bore 616 by a biasing mechanism, such as a spring 692. One or more retaining elements, such as ball bearings 674, travel in one or more longitudinal guides, such as slots 678, which may either extend the length of the bore 616 or may stop at a step 619. Other illustrated elements, such as collet 645, toolbit 655, collet nut 665, and cap 694, may be as previously described.

A further embodiment of the engraving toolholder is shown in FIGS. 15–17. In this embodiment, a toolbit holder assembly includes an internal toolholder 731 into which a toolbit 755 is placed and secured with one or more setscrews 756. A retaining mechanism 770 includes an endcap 772 threaded onto the front end of the shaft of the main body 712 to retain the internal toolholder inside the bore 716. The biasing mechanism 790 includes a spring 792 and a cap 794 placed at the back end of the main body. This puts pressure on the internal toolholder and presses it against the endcap. By pushing against the toolbit, the internal toolholder slides toward the back of the bore. The spring provides pressure to push the toolbit back towards the endcap. This allows for relatively constant pressure applied to the toolbit when it is in contact with a material during engraving. Rotation of the internal toolholder may be prevented in a manner such as described above. For example, ball bearings 774 or protrusions (see FIG. 5) in the internal toolholder can travel in longitudinal slots 778 in the main body 712.

Figure 18:
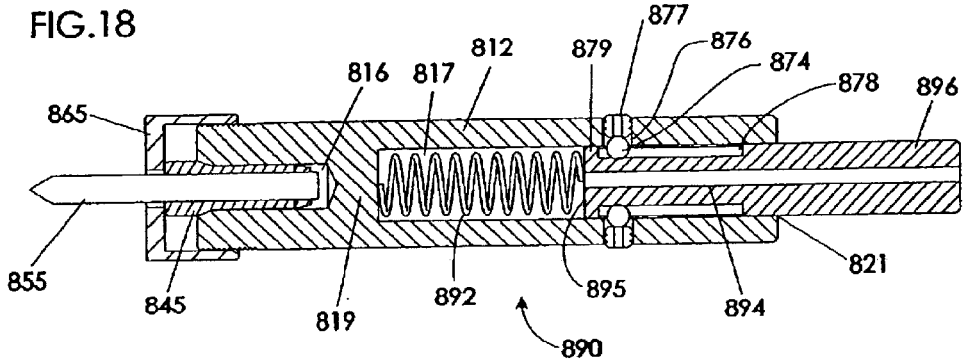
FIG. 18 is a cross sectional view of a still further embodiment of a spring-loaded engraving toolholder of the present invention.
Figure 19:
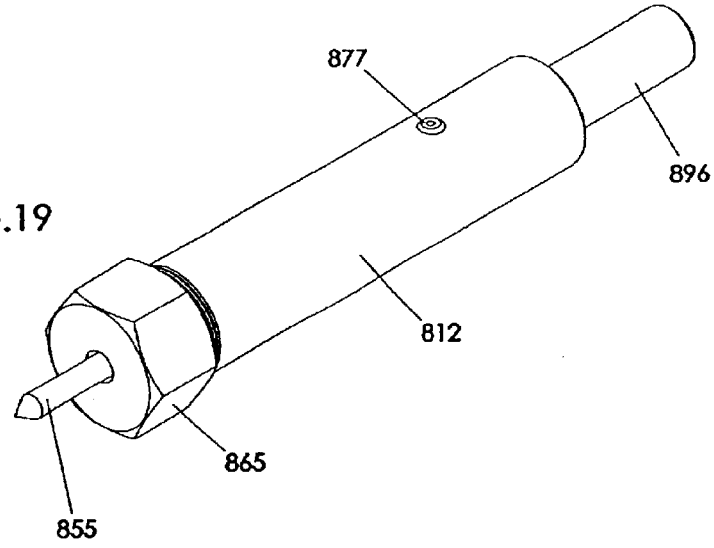
FIG. 19 is a perspective view of the toolholder of FIG. 18.

FIGS. 18 and 19 illustrate a further embodiment in which the bore within a main body 812 is divided into a front bore section 816 and a rear bore section 817 by an abutment section 819. The front bore section and rear bore section may have different diameters. The abutment section can be, for example, a wall element integrally formed with the main body or attached thereto in any suitable manner. A toolbit 855 is retained within the front bore section 816 in the main body via a collet 845. The collet and toolbit are secured to the main body in any suitable manner, such as with a collet nut 865. In this manner, the toolbit moves unitarily with the main body.

A biasing mechanism 890 includes a compressible element, such as a spring 892, that fits within the rear bore section 817. A retaining member 894 fits within and extends through a rear opening 821 of the rear bore section 817. The spring is compressible between the abutment section 819 and an opposing face 895 of the retaining member. The retaining member includes a rear extension 896 configured to be held in a collet or endmill toolholder of an engraving machine. The outer diameter of the rear extension is selected based on the engraving machine.

The main body 812, collet 845, and toolbit 855 are longitudinally translatable with respect to the retaining member 894 while being restrained from rotation with respect to the retaining member. In the illustrated embodiment, the biasing mechanism includes a retaining element or elements, such as ball bearings 874, fixed via set screw 877 in holes 876 in the main body. The ball bearings travel in one or more longitudinal guides, such as slots 878 in the retaining member 894. A shoulder 879 prevents the retaining member from being removed from the main body. Other mechanisms to provide longitudinal reciprocal translation of the retaining member with respect to the main body, such as those described above, can be used.

In operation, the biasing mechanism provides pressure to bias the toolbit via the main body against the workpiece, thereby compensating for a workpiece that is not perfectly level or has an uneven, curved, or sloped surface and providing an even engraving mark. Due to the precise fit between the retaining member 894 and the rear bore section of the main body, an opening may be placed through the retaining member to allow air to escape from the rear bore section when movement occurs.

The invention is not to be limited by what has been particularly shown and described, except as indicated by the appended claims.

What is claimed is:

1. An engraving toolholder comprising:

a cylindrical body configured to be held in a collet or endmill toolholder of an engraving machines;

a mechanism for holding a toolbit, the toolbit holding mechanism comprising a collet configured to clamp a toolbit therein and a cylindrical body having a front bore section. and a rear bore section extending axially therethrough, an abutment section separating the front bore section and the rear bore section, and a toolbit holder assembly configured to fixedly retain a toolbit in the front bore section of the main body;

a mechanism for biasing the toolbit holding mechanism in a direction toward a workpiece when the cylindrical body is held in the engraving machine, the biasing mechanism configured to apply a pressure in response to variations in a surface of the workpiece with respect to the engraving machine to produce an even engraving mark on the workpiece, the biasing mechanism comprising:

a retaining member disposed for longitudinal reciprocal translation in the rear bore section of the cylindrical body, the retaining member restrained from rotation within the rear bore section, and a compressible element disposed between the abutment section and the retaining member to apply a biasing force to the cylindrical body in a direction toward a workpiece when the engraving toolholder is held in an engraving machine; and the cylindrical body comprises a portion of the retaining member extending from a rear opening of the rear bore section and configured to be held in a collet or endmill toolholder of an engraving machine.

2. The engraving toolholder of claim 1, wherein the toolbit holder assembly comprises a collet configured to retain a toolbit therein, the collet at least partially disposed in the front bore section, and a collet nut fastened to a front end of the main body to retain the collet in the front bore section.

3. The engraving toolholder of claim 1, further comprising one or more retaining elements in the rear bore section of the main body travelable along one or more cooperative longitudinal guides, the retaining elements and cooperative longitudinal guides disposed between the main body and the retaining member to provide the longitudinal reciprocal translation of the main body with respect to the retaining member.

4. The engraving toolholder of claim 1, wherein the retaining member has a central opening therethrough.

5. An engraving toolholder comprising:

a main body configured to be held in a collet or endmill toolholder of an engraving machine;

the main body having a bore extending axially through at least a portion of the main body, the bore having an open front end;

a toolbit holder assembly disposed within the bore of the main body;

the toolbit holder assembly disposed for longitudinal reciprocal translation along an axis of the main body;

the toolbit holder assembly retained within the main body;

the toolbit holder assembly restrained from rotation within the main body; and a biasing mechanism disposed to bias the toolbit holder assembly toward a workpiece in the direction of the open front end.

6. The engraving toolholder of claim 5, wherein the biasing mechanism comprises a compressible element disposed within the bore of the main body, a back end of the compressible element abutting against a surface at a rear portion of the main body, a front end of the compressible element abutting against the toolbit holder assembly.

7. The engraving toolholder of claim 5, wherein the biasing mechanism comprises a spring disposed within the bore of the main body, a back end of the spring abutting against a surface at a rear portion of the main body, a front end of the spring abutting against the toolbit holder assembly.

8. The engraving toolholder of claim 7, further comprising a retaining screw disposed within the rear portion of the main body, the retaining screw providing the surface abutting against the back end of the spring.

9. The engraving toolholder of claim 8, wherein the retaining screw has a central opening therethrough.

10. The engraving toolholder of claim 5, wherein the toolbit holder assembly comprises:

a collet holder disposed for longitudinal reciprocal translation in the main body, the collet holder having a toolbit end;

a collet configured to retain a toolbit therein, the collet disposed within the toolbit end of the collet holder; and a collet nut fastened to the toolbit end of the collet holder to retain the collet therein.

11. The engraving toolholder of claim 10, wherein the collet nut is threadably engaged on the end of the collet holder.

12. The engraving toolholder of claim 10, wherein the collet is configured to releasably retain the toolbit therein.

13. The engraving toolholder of claim 10, wherein the collet holder includes one or more retaining elements disposed to extend from an outer surface thereof, the one or more retaining elements cooperatively received in one or more longitudinal guides formed on an inner surface of the main body, whereby the one or more retaining elements guide travel of the collet holder along the axis of the main body.

14. The engraving toolholder of claim 13, wherein the one or more retaining elements comprise ball bearings rollably received in apertures in the collet holder, and the one or more longitudinal guides comprise longitudinal slots.

15. The engraving toolholder of claim 14, wherein the one or more retaining elements comprise protrusions formed to extend from the outer surface of the collet holder, and the one or more longitudinal guides comprise longitudinal slots.

16. The engraving toolholder of claim 15, wherein the one or more longitudinal guides extend along a portion of the inner surface of the main body.

17. The engraving toolholder of claim 13, wherein the one or more retaining elements comprise longitudinal grooves formed in the outer surface of the collet holder, and the one or more longitudinal guides comprise correspondingly-shaped grooves formed in the inner surface of the main body.

18. The engraving toolholder of claim 17, wherein the grooves are square-shaped in cross-section.

19. The engraving toolholder of claim 13, wherein the one or more longitudinal guides extend substantially the length of the main body.

20. The engraving toolholder of claim 13, wherein the one or more retaining elements and the one or more longitudinal guides comprise complementary splines.

21. The engraving toolholder of claim 10, wherein each of the end cap and the collet nut has a hexagonal outer configuration.

22. The engraving toolholder of claim 10, wherein each of the collet nut arid the end cap has a cylindrical outer configuration and a wrench flat formed on a portion of the outer surface.

23. The engraving toolholder of claim 10, wherein each of the collet holder, the collet nut, and the end cap has a wrench flat formed on a portion of an outer surface thereof.

24. The engraving toolholder of claim 5, further comprising one or more retaining elements travelable along one or more cooperative longitudinal guides, the retaining elements and cooperative longitudinal guides disposed between the main body and the toolbit holder assembly to provide the longitudinal reciprocal translation of the toolbit holder assembly with respect to the main body.

25. The engraving toolholder of claim 5, further comprising a retaining mechanism disposed to retain the toolbit holder assembly within the bore of the main body.

26. The engraving toolholder of claim 25, wherein the retaining mechanism comprises an end cap securable over the front end of the main body, the end cap including an annular shoulder directed radially inwardly, the toolbit holder assembly including retaining elements disposed to abut against the shoulder of the end cap.

27. The engraving toolholder of claim 25, wherein the retaining mechanism comprises an annular shoulder directed radially inwardly at the front end of the main body, the toolbit holder assembly including retaining elements disposed to abut against the shoulder of the end cap.

28. The engraving toolholder of claim 5, further comprising a rotational restraining mechanism disposed to restrain the toolbit holder assembly from rotation within the main body.

29. The engraving toolholder of claim 28, wherein the rotational restraining mechanism comprises one or more retaining elements disposed to extend from an outer surface of the toolbit holder assembly, the one or mare retaining elements cooperatively received in one or more longitudinal guides formed on an inner surface of the main body, whereby the one or more retaining elements guide travel of the toolbit holder assembly along the axis of the main body.

30. The engraving toolholder of claim 29, wherein the one or more retaining elements comprise ball bearings rollably received in apertures in the toolbit holder assembly, and the one or more longitudinal guides comprise longitudinal slots.

31. The engraving toolholder of claim 29, wherein the one or more retaining elements comprise protrusions formed to extend from the outer surface of the toolbit holder assembly, and the one or more longitudinal guides comprise longitudinal slots.

32. The engraving toolholder of claim 29, wherein the one or more longitudinal guides extend along a portion of the inner surface of the main body.

33. The engraving toolholder of claim 29, wherein the one or more retaining element a comprise longitudinal grooves formed in the outer surface of the toolbit holder assembly, and the one or more longitudinal guides comprise correspondingly-shaped grooves formed in the inner surface of the main body.

34. The engraving toolholder of claim 33, wherein the grooves are square-shaped in cross-section.

35. The engraving toolholder of claim 29, wherein the one or more longitudinal, guides extend substantially the length of the main body.

36. The engraving toolholder of claim 29, wherein the one or more retaining elements and the one or more longitudinal guides comprise complementary splines.

37. The engraving toolholder of claim 5, wherein the toolbit holder assembly comprises:

a toolholder having an aperture therein sized to receive a toolbit; p1 a fastening element configured to retain the toolbit in the aperture; and an end cap engageable with the front end of the main body to retain the toolholder within the main body.

38. The engraving toolholder of claim 37, wherein the fastening element comprises a set screw.

39. The engraving toolholder of claim 37, further comprising a retaining screw disposed within a rear portion of the main body and having a shaft extension protruding from the rack end of the main body, the shaft extension having an outer diameter configured to be received in an engraving machine.

40. The engraving toolholder of claim 39, wherein the outer diameter of the shaft extension is legs than an outer diameter of the main body.

41. The engraving toolholder of claim 5, wherein the main body has a cylindrical outer configuration.

42. An engraving toolholder comprising:

an elongated main body having a front bore section and a rear bore section extending axially therethrough, an abutment section separating the front bore section and the rear bore section a toolbit holder assembly configured to fixedly retain a toolbit in the front bore section of the main body; and a biasing mechanism disposed in the rear bore section, the biasing mechanism comprising:

a retaining member disposed for longitudinal reciprocal translation in the rear bore section, the retaining member restrained from rotation within the rear bore section, a portion of the retaining member extending from a rear opening of the rear bore section and configured to be held in a collet or endmill toolholder of an engraving machine, and a compressible element disposed between the abutment wall and the retaining member to apply a biasing force on the main body in a direction toward a workpiece when the engraving toolholder is held in an engraving machine.

43. The engraving toolholder of claim 42, wherein the toolbit holder assembly comprises a collet configured to retain a toolbit therein, the collet at least partially disposed in the front bore section, and a collet nut fastened to a front end of the main body to retain the collet in the front bore section.

44. The engraving toolholder of claim 43, wherein the collet nut is threadably engaged on the front end of the main body.

45. The engraving toolholder of claim 43, wherein the collet is configured to releasably retain the toolbit therein.

46. The engraving toolholder of claim 42, further comprising one or more retaining elements in the rear bore section of the main body travelable along one or more cooperative longitudinal guides, the retaining elements and cooperative longitudinal guides disposed between the main body and the retaining member to provide the longitudinal reciprocal translation of the main body with respect to the retaining member.

47. The engraving toolholder of claim 46, wherein the retaining elements comprise ball bearings disposed in apertures in the rear bore section and the longitudinal guides comprise slots in the retaining member.

48. The engraving toolholder of claim 42, wherein the retaining member further includes a shoulder disposed to prevent removal of the retaining member from the rear bore section.

49. An engraving toolholder comprising:

a cylindrical body configured to be held in a collet or endmill toolholder of an engraving machine, the cylindrical body comprising a main body having a bore extending axially through at least a portion of the main body, the bore having an open front end;

means for holding a toolbit, the toolbit holding means comprising a collet configured to clamp a toolbit therein and a toolbit holder assembly disposed for longitudinal reciprocal translation in the bore of the main body; and means for biasing the toolbit holding means in a direction toward a workpiece when the cylindrical body is held in the engraving machine, the biasing means configured to apply a pressure in response to variations in a surface of the workpiece with respect to the engraving machine to produce an even engraving mark on the workpiece, the biasing means comprising a compressible element disposed within the bore of the main body, a back end of the compressible element abutting against a surface at a rear portion of the main body, a front end of the compressible element abutting against the toolbit holder assembly; and one or more retaining elements travelable along one or more cooperative longitudinal guides, the retaining elements and cooperative longitudinal guides disposed between the main body and the toolbit holder assembly to provide the longitudinal reciprocal translation of the toolbit holder assembly with respect to the main body.

50. The engraving toolholder of claim 49, wherein the toolbit holding assembly comprises a collet holder the collet retained in the collet holder.

51. An engraving toolholder comprising:

a cylindrical body configured to be held in a collet or endmill toolholder of an engraving machine;

means for holding a toolbit, the toolbit holding means comprising a collet configured to clamp a toolbit therein and a cylindrical body having a front bore section and a rear bore section extending axially therethrough, an abutment section between the front bore section and the rear bore section, and a toolbit holder assembly configured to fixedly retain a toolbit in the front bore section of the main body;

means for biasing the toolbit holding means in a direction toward a workpiece when the cylindrical body is held in the engraving machine, the biasing means configured to apply a pressure in response to variations in a surface of the workpiece with respect to the engraving machine to produce an even engraving mark on the workpiece, the biasing means comprising:

a retaining member disposed for longitudinal reciprocal translation in the rear bore section of the cylindrical body, the retaining member restrained from rotation within the rear bore section, and a compressible element disposed between the abutment section and the retaining member to apply a biasing force to the cylindrical body in a direction toward a workpiece when the engraving toolholder is held in an engraving machine; and the cylindrical body comprises a portion of the retaining member extending from a rear opening of the rear bore section and configured to be held in a collet or endmill toolholder of an engraving machine.

52. The engraving toolholder of claim 51, wherein the collet is at least partially disposed in the front bore section, and a collet nut is fastened to a front end of the main body to retain the collet in the front bore section.

53. The engraving toolholder of claim 51, further comprising one or more retaining elements in the rear bore section of the main body travelable along one or mere cooperative longitudinal guides, the retaining elements and cooperative longitudinal guides disposed between the main body and the retaining member to provide the longitudinal reciprocal translation of the main body with respect to the retaining member.

54. The engraving toolholder of claim 51, wherein the retaining member has a central opening therethrough.

* * * * *

UNITED STATES PATENT AND TRADEMARK OFFICE

CERTIFICATE OF CORRECTION

PATENT NO. : 6,834,434 B2
DATED : December 28, 2004
INVENTOR(S) : Lance Nelson

It is certified that error appears in the above-identified patent and that said Letters Patent is hereby corrected as shown below:

Column 1,
Line 66, delete "30";

Column 7,
Line 46, "machines;" should read -- machine; --;

Column 9,
Line 45, "arid" should read -- and --;

Column 10,
Line 11, "mare" should read -- more --;
Line 29, "element a" should read -- elements --;
Line 45, delete "p1";
Line 51, "claim 37" should read -- claim 5 --;
Line 54, "rack" should read -- back --;
Line 58, "legs" should read -- less --; and Column 12,
Line 51, "mere" should read -- more --.

Signed and Sealed this

Seventh Day of June, 2005

JON W. DUDAS
*Director of the United States Patent and Trademark Office*